United States Patent [19]

Marks

[11] 3,965,506

[45] June 29, 1976

[54] FURNITURE CONSTRUCTION

[76] Inventor: Robert J. Marks, 210 Johnson Ferry Road, Atlanta, Ga. 30328

[22] Filed: Mar. 4, 1975

[21] Appl. No.: 555,168

[52] U.S. Cl. ..... 5/345 R; 5/355; 297/456

[51] Int. Cl.[2] ..... A47C 23/00; A47C 27/00

[58] Field of Search ..... 297/456, DIG. 1; 5/345, 5/355, 361 R, 361 B, 361

[56] References Cited

UNITED STATES PATENTS

| | | | |
|---|---|---|---|
| 3,361,611 | 1/1968 | Stark | 229/7 R X |
| 3,572,836 | 3/1971 | Khanh | 297/456 |
| 3,761,131 | 9/1973 | Oliver | 297/456 |
| 3,807,801 | 4/1974 | Dalsgard | 297/456 |

OTHER PUBLICATIONS

Washington Star, Dec. 10, 1974.

*Primary Examiner*—Paul R. Gilliam
*Assistant Examiner*—Andrew M. Calvert
*Attorney, Agent, or Firm*—B. J. Powell

[57] ABSTRACT

An article of furniture which has a cover of a flexible material having strength generally only in tension which defines a closed cushion chamber therein filled with ground flakes of expanded plastic material mixed with shredded particles of foam rubber. The cover may be made of an elongate generally rectangular piece of flexible material folded back over itself midway its length with the opposed side edges of the material overlying each other seamed together and the overlying ends of the material attached together so that the opposed side seams overlie each other at the overlying ends to form a chair. The cover may also be made in the form of a generally rectilinear seat cushion with a front edge, a generally parallel rear edge and a pair of end edges connecting the front and rear edges, and an elongate bolster having a length approximately equal to the sum of the lengths of the rear edge and both ends of the seat cushion with the opposite ends of the bolster attached to the seat cushion at the opposite ends of the front edge so that the bolster forms the back and arms of a couch. The disclosure also contemplates the method of manufacture of the furniture.

4 Claims, 7 Drawing Figures

FURNITURE CONSTRUCTION

BACKGROUND OF THE INVENTION

Pillow type furniture is available on the market today. Such furniture usually includes a flexible free form cover which has strength only in tension and which defines a cushion chamber therein. The cushion chamber is usually filled with a soft resilient material such as sponge rubber to make the furniture resilient. One of the problems with this furniture is the fact that the soft resilient material which filled the cover did not have enough structural integrity to provide an article of furniture with a back support without an auxiliary frame. Another problem with such prior art pillow furniture is that, in order to obtain the desired shape for the furniture, it was necessary to use different shaped pieces of material in the cover thereby requiring a higher manufacturing cost than was desirable. As a result of these deficiencies, prior art pillow type furniture has been unable to provide an economical alternative to standard furniture.

SUMMARY OF THE INVENTION

These and other problems and disadvantages associated with the prior art are overcome by the invention disclosed herein by providing pillow type furniture in which the free form cover, while having strength only in tension, is filled with a cushion material which is both resilient and possesses enough structural integrity to provide a back rest on the furniture. Further, the cushion material filling the cover can be readily reshaped to different configurations without affecting the structural integrity thereof so as to continue to produce a back support. Also, because of the structural integrity of the cushion material, a simplified cushion construction is obtainable which serves to reduce the overall manufacturing cost of the furniture to a level that is economically competitive with standard furniture.

The furniture of the invention includes a cover made of a flexible material such as fabric which has been attached together to form a cushion chamber therein. The cushion chamber is filled with a mixture of expanded plastic material such as expanded polystyrene that has been ground into small flakes and shredded foam rubber material such as polyeurthane foam with the ground expanded plastic material possessing enough structural integrity to maintain the general shape of the furniture while the shredded foam rubber provides the desired resiliency in the furniture. This cushion mixture also may be reformed while still maintaining the structural integrity of the furniture so that different configurations of the furniture is attainable.

The article of furniture may be embodied as a chair by forming the cover with an elongate piece of flexible material folded back over itself midway its length so that the opposed ends of the material overlie each other to form an overlapped end where the opposed ends of the material overlie each other and a folded end opposite the overlapped end where the material is folded. The opposed overlying edges of the material are attached together along their length to form opposed side seams and the overlying ends of the material are attached together at the overlapped end so that the opposed side seams overlie each other at the overlapped end to form the cushion chamber which is then filled with the resilient cushion material. Thus, when the filled cover is placed on a supporting surface such as the floor so that the overlapped end or the folded end is generally parallel to the supporting surface, a seat with a back rest is formed.

The article of furniture also may be embodied in a couch which has a generally rectilinear seat cushion having a free form cover filled with the cushion material so that it has a rear edge and a front edge generally parallel and a pair of generally parallel opposed ends connecting the front and rear edges of the seat cushion. An elongate bolster which has a length approximately equal to the sum of the lengths of the rear edge and both ends of the seat cushion has its opposite ends attached to opposite ends of the front edge and folded so that the bolster has a back section generally lying along the rear edge of the seat cushion and supported thereon and a pair of generally opposed arm sections generally lying along opposed ends of the seat cushion.

These and other features and advantages of the invention will become more clearly understood upon consideration of the following specification and accompanying drawings wherein like characters of reference designate corresponding parts throughout the several views.

These figures and the following detailed description disclose specific embodiments of the invention, however, it is to be understood that the inventive concept is not limited thereto since it may be embodied in other forms.

DETAILED DESCRIPTION OF ILLUSTRATIVE EMBODIMENTS

Figure 1:
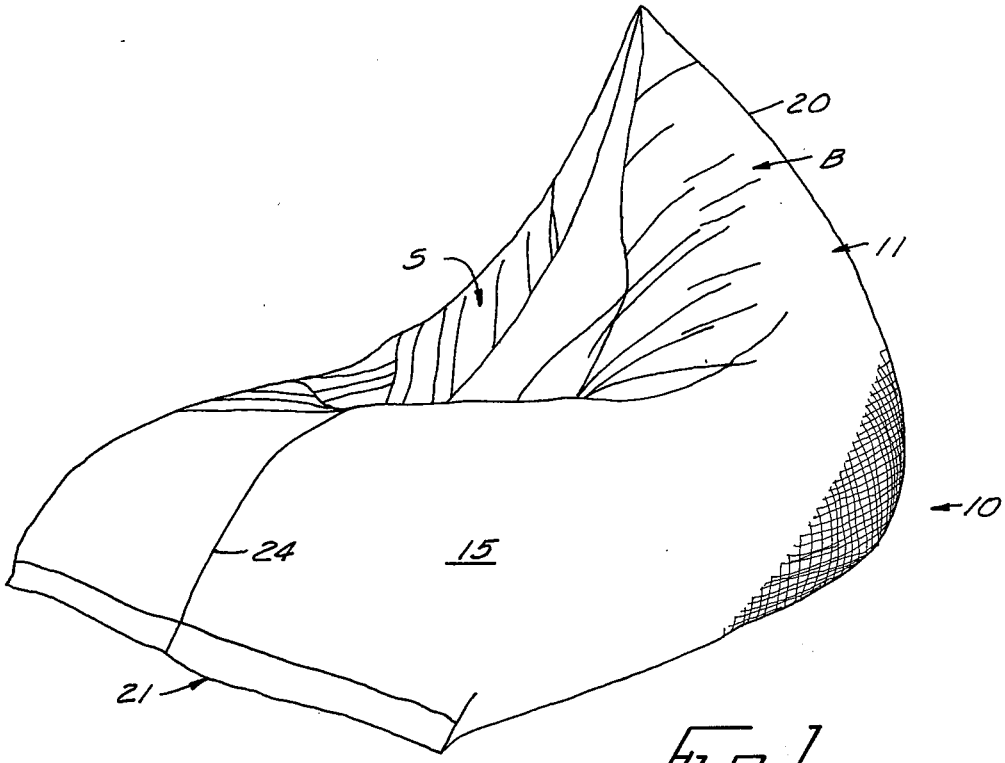
FIG. 1 is a perspective view of a chair embodying the invention.
Figure 2:
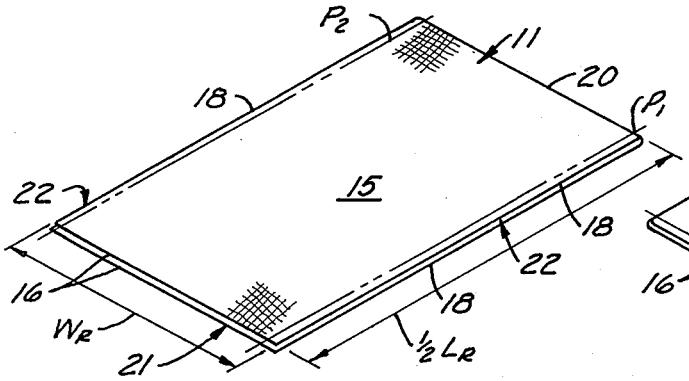
FIGS. 2 and 3 are perspective views illustrating the construction of the chair shown in FIG. 1.
Figure 3:
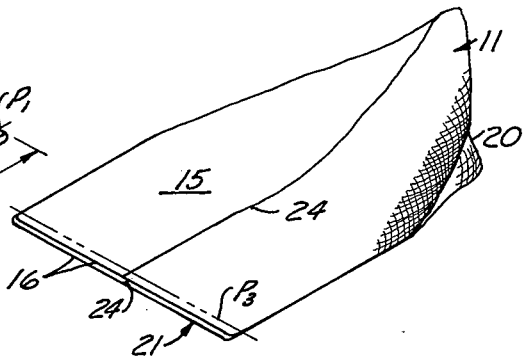
Figure 6:
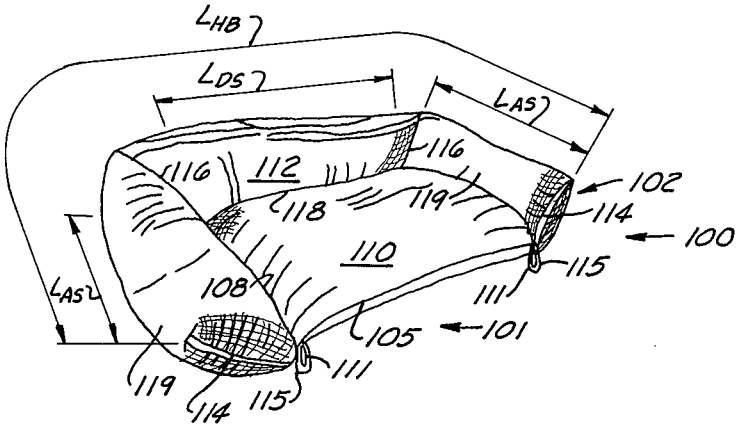
FIG. 6 is a perspective view of a couch embodying the invention.
Figure 7:
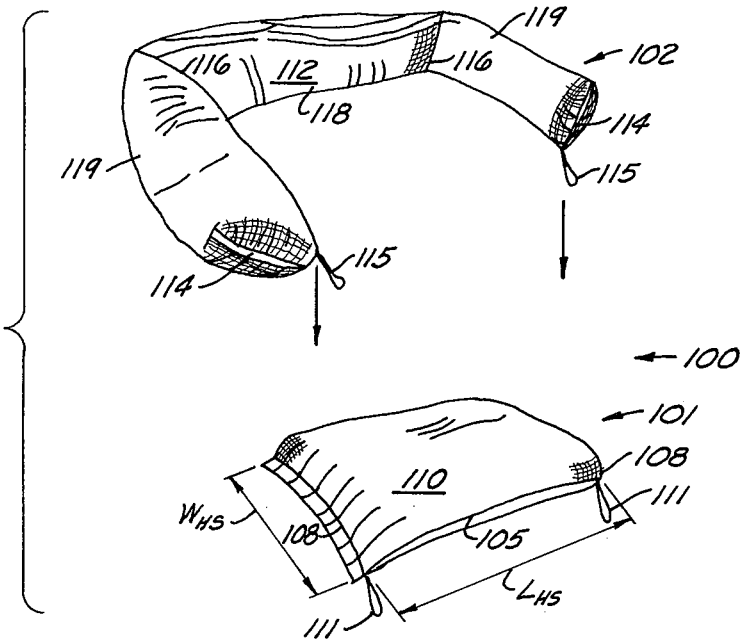
FIG. 7 is an exploded perspective view showing the bolster removed from the seat cushion of the couch shown in FIG. 6.

FIGS. 1–3 illustrate a chair 10 embodying the invention while FIGS. 6 and 7 illustrate a couch 100 embodying the invention. Both the chair and the couch have a similar construction in that both have a flexible free form cover formed of a flexible material such as fabric or plastic that have strength only in tension. Both the chair and couch have their covers filled with a cushion material which has both resiliency and sufficient structural integrity to support the general shape of the article of furniture but which may be reformed into different shapes as will become more apparent.

Figure 4:
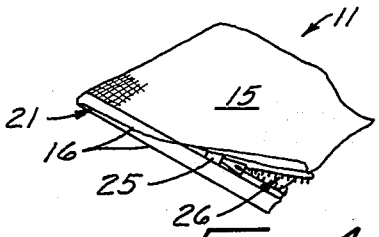
FIG. 4 is a partial perspective view illustrating the closure of the chair of FIG. 1.
Figure 5:
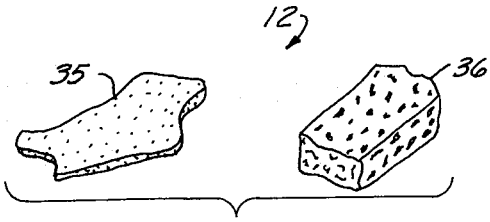
FIG. 5 is a perspective view of the particles forming the filling material of the invention.

Referring to FIGS. 1–5, it will be seen that the chair 10 includes generally a cover 11 which is filled with a cushion material 12 best seen in FIG. 5. The construction of the cover 11 is best understood upon reference to FIGS. 2 and 3 which shows the construction thereof. As seen in FIG. 2, the cover 11 is a single sheet 15 of material generally rectilinear in shape with opposed end edges 16 and opposite side edges 18. The sheet 15 is made of a flexible material such as fabric or plastic or a combination thereof which is free forming in that it has strength only in tension. While a single piece of material is illustrated for the sheet 15, it may be made up of different pieces of material sewn together to obtain different designs. As seen in FIG. 2, the sheet 15 has a length $L_R$ and a width $W_R$. Preferably, the length $L_R$ should be 2.5–3.6 times the width $W_R$. The sheet 15 is folded back over itself midway its length to form a folded end 20 with the end edges 16 overlying each other at an overlapped end 21 opposite the folded end 20 and with opposite sides 22 formed by the overlying side edges 18 of the sheet 15. The side seams 24 are made along the sides 22 to sew the side edges 18 of the sheet 15 together along generally parallel paths $P_1$ and $P_2$. This leaves the overlapped end 21 open.

As seen in FIG. 3, the thusly sewn sheet 15 is then turned inside out so that the side seams 24 formed along paths $P_1$ and $P_2$ are finished and the cover 11 is then re-oriented as seen in FIG. 3 so that the side seams 24 formed along the paths $P_1$ and $P_2$ overlie each other at the overlapped end 21. Thus, it will be seen that the folded edge 20 is generally perpendicular both to the side seams 24 and the overlapped end 21. The overlying ends 16 at the overlapped end 21 are then connected together along the path $P_3$ while the seams 24 overlie each other at the end 21 by sewing a zipper 25 as best seen in FIG. 4 along the path $P_3$ seen in FIG. 3. With the zipper 25 closed, it will be seen that a cushion chamber 26 is formed within the cover 11 which can be selectively opened and closed by the zipper 25. The zipper 25 is then opened and the cover 11 filled with the cushion material 12 whereupon the zipper 25 is reclosed. The complete chair 10 is then placed on a supporting surface such as the floor with the overlapped end 21 generally parallel to the surface of the floor and the folded end 20 generally normal to the surface of the floor to form the chair shape seen in FIG. 1. Thus, a seat S is formed between the ends 20 and 21 and a back support B is formed adjacent the folded end 20. Alternatively, the folded end 20 may be placed generally parallel to the floor surface while the overlapped end 21 may be placed generally normal to the floor surface to produce the same general shape for the chair 10 shown in FIG. 1.

The cushion material 12 includes expanded plastic material such as expanded polystyrene which has been ground into thin flakes of relatively small size such as approximately one-quarter to three-quarter inches in length and width. These flakes 35 have a generally rough exterior surface so that when they are massed together within the chamber 26, the frictional interface therebetween prevents the flakes 35 from easily sliding with respect to each other and thus maintain the general shape of the chair 10 when a person sits on the seat S and leans back on the back support B. It will further be noted, however, that because the flakes 35 are not positively interconnected, the chair 10 can be somewhat reshaped by shifting the flakes 35 around within the cover 11 when the weight is removed therefrom. The chair 10 will then retain this newly formed shape when weight is again applied to the chair. The flakes 35 have limited compressibility and resilience and tend to take a permanent compressive set after extended usage. This can be compensated by opening zipper 25 and adding more flakes 35.

The cushion material 12 also includes a shredded foam rubber material such as polyeurthane foam that has been shredded into small particles 36 which are flexible and resilient, and can be easily compressed without a permanent compressive set. While the particles 36 have little structural integrity, they do enhance the resiliency of the cushion material so that the softness of the chair 10 can be easily and readily controlled. Because the flakes 35 are flexible yet have limited resilience, they serve to maintain the overall structural integrity of the chair 10 while the particles 36 of shredded foam rubber provide the desired resiliency to the chair. While different relative proportions of the flakes 35 and the particles 36 may be used, one proportion that has been found satisfactory is a mixture of 50% flakes 35 and 50% particles 36 by volume. Preferably the expanded plastic material and foam rubber are of the self-extinguishing type to reduce fire hazard.

As seen in FIGS. 6 and 7, the couch 100 includes generally a seat cushion 101 and bolster 102. The seat cushion 101 is generally rectilinear in shape with a front edge 105 and a generally parallel rear edge 106. The opposite ends of the edges 105 and 106 are joined by end edges 108 which are also generally parallel to each other and normal to the edges 105 and 106. The cushion 101 has a flexible cover 110 made of a flexible material such as fabric or plastic that has strength only in tension and which is filled with a mixture of the cushion material 12 in a similar manner as the chair 10. A convenient access opening is provided in the cover 110 of the seat cushion 101 which can be opened and closed in a manner similar to that described for the overlapped end of the cover 11 so that the seat cushion 101 may be selectively refilled. It will thus be seen that the seat cushion 101 has a length $L_{HS}$ and a width $W_{HS}$. Seat ties 111 are connected to opposite ends of the front edge 105 for use in attaching the bolster 102 to the cushion 101 as will become more apparent.

The bolster 102 also has a cover 112 made of a flexible material such as fabric or plastic which is filled with the cushion material 12 similarly to the chair 10 so that it has a generally oval cross-sectional shape. The bolster 102 has an average length $L_{HB}$ which is generally equal to the sum of the length $L_{HS}$ and two times the width $W_{HS}$. The opposite ends 114 of the bolster 102 are equipped with bolster ties 115 at its inside bottom point so that the opposite ends 114 of the bolster 102 can be tied to the opposite ends of the front edge 105 of the cushion 101 with the ties 111. With the ties 111 and 115 tied to each other as seen in FIG. 6, the bolster 102 is folded in spaced apart positions indicated at 116 so that the back section 118 is formed between the folds 116 and a pair of arm sections 119 are formed between each fold 116 and its associated end 114. This causes each of the arm sections 119 to have an inside length $L_{AS}$ which is less than the width $W_{HS}$ of the cushion 101 and the back section 118 to have a length $L_{DS}$ which is less than the length $L_{HS}$. Thus, it will be seen that the back section 118 is supported on the back portion of the seat cushion 101 along the rear edge 106 and the arm sections 119 are supported on the opposite ends of the cushion 101 at the rear ends of the arm sections 119 and angle outwardly therefrom to the ties 111 and 115 so that the bottom portion of the opposite ends 114 of the bolster 102 is supported on the surface such as a floor supporting the seat cushion 101. Thus, it will be seen that the arm sections 119 extend forwardly and flare outwardly so that the upper edges of the arm sections 119 are lower adjacent the ends 114 than at the folds 116.

While specific embodiments of the invention have been disclosed herein, it is to be understood that full use may be made of modifications, substitutions and equivalents, without departing from the scope of the inventive concept.

I claim:

1. An article of furniture adapted to be supported on a supporting surface comprising:

a cover including an elongate rectilinear piece of flexible material having strength only in tension folded back over itself midway its length so that the opposed ends of the material overlie each other to form an overlapped end where the opposed ends of the material overlie each other and a folded end opposite the overlapped end where the material is folded, the opposed overlying side edges of the material attached together along their lengths to form opposed, generally parallel side seams and the overlying ends of the material attached together at the overlapped end so that the opposed side seams overlie each other at the overlapped end to form a cushion chamber therein; and, a resilient cushion material having sufficient structural integrity to maintain the general shape of the article of furniture when a weight is imposed thereon corresponding to the general shape of the article of furniture when the weight is removed therefrom, filling said cushion chamber so that when the article of furniture is placed on the supporting surface so that the overlapped end is generally parallel to the supporting surface and the folded end is generally normal to the supporting surface and, alternatively, if the overlapped end is generally normal to the supporting surface and the folded end is generally parallel to the supporting surface, a seat with a back rest is formed, said cushion material including a first prescribed portion of ground flakes of expanded plastic material and a second prescribed portion of shredded foam rubber mixed together.

2. The article of furniture of claim 1 wherein said overlying ends of the material attached together at the overlapped end is releasably attached together so that additional cushion material may be added to said chamber.

3. The article of furniture of claim 2 further including a zipper releasably attaching the overlying ends of the material together at the overlapped end.

4. An article of furniture adapted to be supported on a supporting surface comprising:

a generally rectilinear, resilient seat cushion having a front edge, a rear edge generally parallel to the front edge and a pair of generally parallel opposed end edges connecting the front and rear edges said seat cushion including a flexible cover having strength generally only in tension and defining a cushion chamber therein, and a resilient cushion material filling said seat cushion chamber, said resilient cushion material filling said seat cushion including a mixture of ground flakes of expanded plastic material and shredded foam rubber; and, an elongate resilient bolster having a length generally equal to the sum of the length of the rear edge and both end edges of said seat cushion, the opposite ends of said bolster attached to said seat cushion at generally the opposite ends of the front edge and said bolster folded to form a back section generally lying along the rear edge of said seat cushion and supported thereon, and a pair of generally opposed arm sections generally lying along the opposed ends of said seat cushion said bolster including a flexible cover having strength generally only in tension and defining a bolster cushion chamber therein, and a bolster resilient cushion material filling said bolster cushion chamber, said bolster cushion material including ground flakes of expanded plastic material.

* * * * *